United States Patent [19]

Kreeger

[11] Patent Number: 4,619,366

[45] Date of Patent: Oct. 28, 1986

[54] TWO-LEVEL STACKING CONTAINER

[75] Inventor: Elsmer W. Kreeger, Howell, Mich.

[73] Assignee: Pinckney Molded Plastics, Inc., Howell, Mich.

[21] Appl. No.: 791,926

[22] Filed: Oct. 28, 1985

[51] Int. Cl.[4] ..... B65D 21/04

[52] U.S. Cl. ..... 206/507

[58] Field of Search ..... 206/507

[56] References Cited

U.S. PATENT DOCUMENTS

| | | | |
|---|---|---|---|
| 3,420,402 | 1/1969 | Frater | 206/507 |
| 3,934,724 | 1/1976 | Johnson | 206/507 |
| 3,937,327 | 2/1976 | Carroll | 206/507 |
| 4,093,071 | 6/1978 | Stahl | 206/507 |
| 4,334,616 | 6/1982 | Wilson | 206/505 |
| 4,402,408 | 9/1983 | Kreeger et al. | 206/507 |

FOREIGN PATENT DOCUMENTS

| | | | |
|---|---|---|---|
| 167115 | 5/1959 | Sweden | 206/507 |

*Primary Examiner*—George F. Lowrance

*Attorney, Agent, or Firm*—Basile, Weintraub & Hanlon

[57] ABSTRACT

A two-level stacking container is formed with a square bottom, a pair of first like sidewalls projecting upwardly from two opposed sides of the bottom and a pair of like second sidewalls projecting upwardly from the two remaining sides of the bottom. The first and second sidewalls are formed with a stacking web having top and bottom edges each having vertically spaced alternating upper and lower edge sections so arranged that when two containers are stacked first walls on first walls and second walls on second walls, the containers are in a high level stacked relationship; and when stacked first walls on second walls and second walls on first walls, the containers are in a low stacked relationship.

2 Claims, 10 Drawing Figures

TWO-LEVEL STACKING CONTAINER

BACKGROUND OF THE INVENTION

The present invention is directed to multi-level stacking containers of the type employed typically to transport and deliver bakery products. The invention is particularly concerned with a container so constructed that like containers may be stacked at either a high or a low elevation upon an underlying container as required by the height of the product contained in the lower container.

There are many examples of multi-level stacking containers in the prior art in which two-level stacking is achieved by orienting the upper of two containers into one orientation relative to the lower container to stack at one level and achieving the other level of stacking by shifting the orientation of the upper container 90° or 180° relative to the underlying container. Typically, this is accomplished by having raised and lowered portions on each of two opposed end walls with the raised and lowered portions on one end wall being laterally off-set from those on the other so that when like end walls are stacked upon each other, a first level of stacking is achieved; and when the upper container is reversed by 180° so that unlike end walls are stacked upon each other, a second level of stacking is achieved. In another frequently employed arrangement, two opposed end walls are of a first height and two opposed sidewalls are of a reduced height. In this arrangement, when the end walls are stacked one upon the other, the containers are in a high stacked relationship; while when the upper container is stacked crossways on the lower container, its bottom rests upon the reduced-height sidewalls to achieve a low stacked relationship. Both of these arrangements typically employ a container with a rectangular bottom.

A prior art container embodying both of these stacking arrangements referred to above (to achieve a three-level stacking container) is disclosed in U.S. Pat. No. 4,402,408; see also U.S. Pat. No. 4,334,616. In either of these prior art examples, it will be noted that when the containers are stacked at either of their two higher levels, which would be the case when the containers are filled with products, the upper of two containers is supported upon the underlying container only along two end walls which means that the bottom container of the stack must support the weight of the entire stack on its two end walls.

U.S. Pat. No. 3,937,327 discloses a container having a square bottom with sidewalls formed with webs having alternately inclined sections interconnected at their upper and lower ends as a series of connected upright or inverted V-shaped patterns. The V-shaped patterns differ for each of the four sides of the container and different stacking levels are achieved by different orientations of the upper container relative to the lower. However, stacking to a desired level requires a careful comparison of the sides of the two containers in order to determine the orientation which will achieve the desired stacking level.

The present invention is directed to a container designed for two-level stacking in which high level stacking is achieved in either of two orientations 180° from each other and in which low level stacking is achieved in either of two orientations 90° from either of the high level stacking orientations. The containers further are supported on all four walls by relatively long support surfaces at either stacking level.

SUMMARY OF THE INVENTION

A container embodying the present invention is formed with a square bottom, a pair of like first sidewalls at two opposed sides of the bottom and a pair of like second sidewalls at the other two opposed sides of the bottom. Each of the sidewalls includes a central web having top and bottom edges which constitute the stacking surfaces, the bottom edge of the central webs of the upper container resting upon the top edges of the central webs of the underlying container when the containers are stacked. The top and bottom edges of the central webs are formed with alternating upper and lower edge sections uniformly vertically spaced from each other with the upper and lower edge sections of the top and bottom edges being respectively coextensive with each other longitudinally of the sidewall and being arranged in a pattern symmetrical to the midpoint of the length of the sidewall. The arrangement of the upper and lower edge sections on the first sidewalls are complementary to those on the second sidewalls. Thus, when the containers are stacked with the first and second sidewalls of the upper container resting respectively on the first and second sidewalls of the lower container, the containers will be in a high stacked position. When two containers are stacked with the first and second sidewalls of the upper container resting on the respective second and first sidewalls of the lower container, the containers will be in a low stacked relationship.

Other objects and features of the invention will become apparent by reference to the following specification and to the drawings.

IN THE DRAWINGS

DESCRIPTION OF THE PREFERRED EMBODIMENTS

Figure 1:
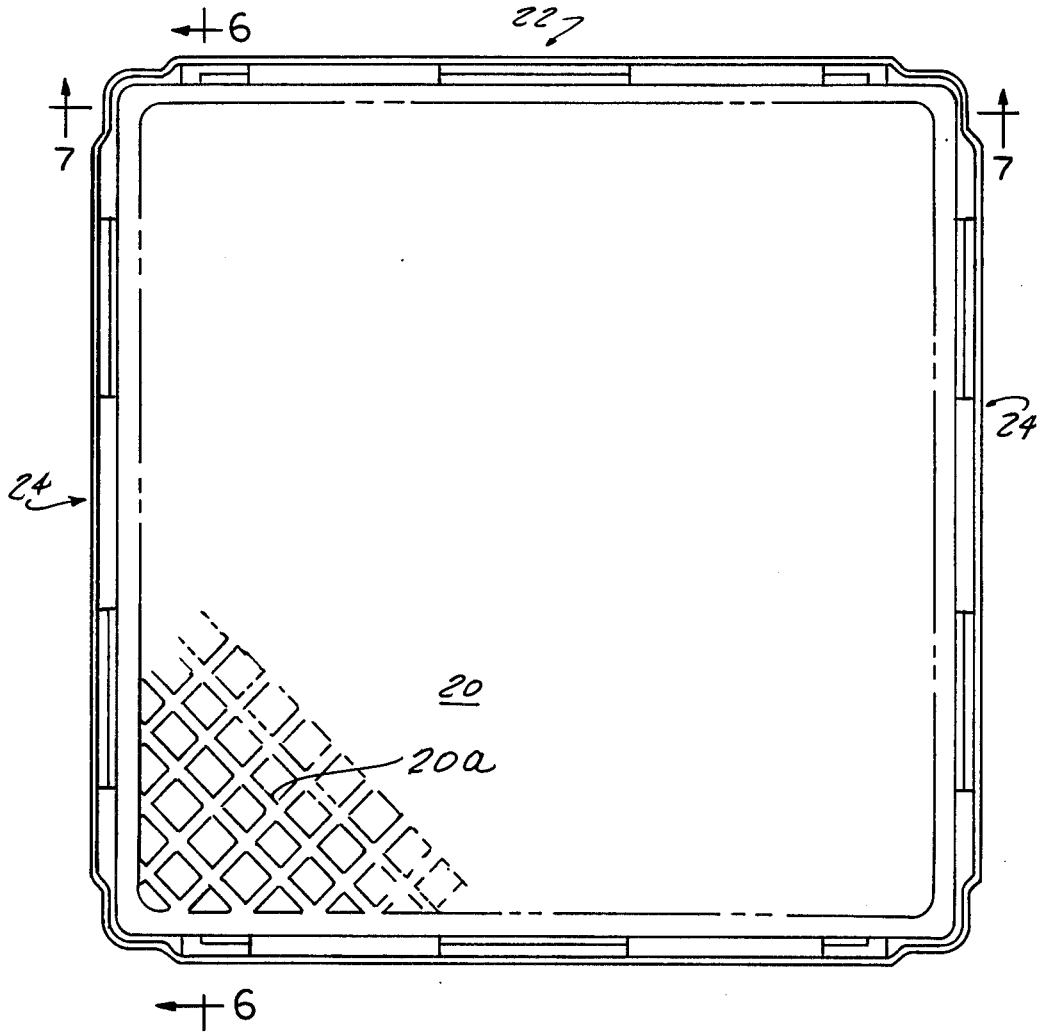
FIG. 1 is a top plan view of a container embodying the present invention.

Referring first to FIG. 1, a container embodying the present invention is formed with a square bottom 20, a pair of first like sidewalls designated generally 22 projecting upwardly from two opposed sides of bottom 20 and a pair of second like sidewalls 24 projecting upwardly from the remaining two opposed sides of bottom 20. Containers of the type disclosed are typically formed as a unitary, one-piece body molded from a suitable thermoplastic material, such as polypropylene.

To reduce the weight of the container, the bottom may be formed as an open grid as partially illustrated at 20A and the sidewalls of the container may be formed with various recesses or openings, which have not been illustrated in order to more clearly show those portions of the container structure which have some direct involvement with the stacking features of the container.

Figure 2:
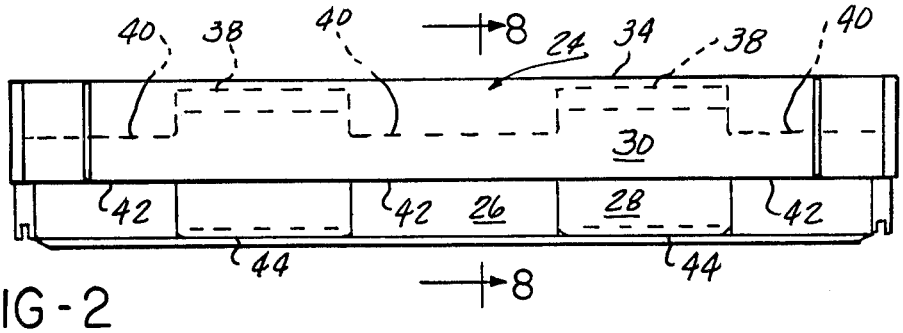
FIG. 2 is a side elevational view of the container of FIG. 1.
Figure 6:
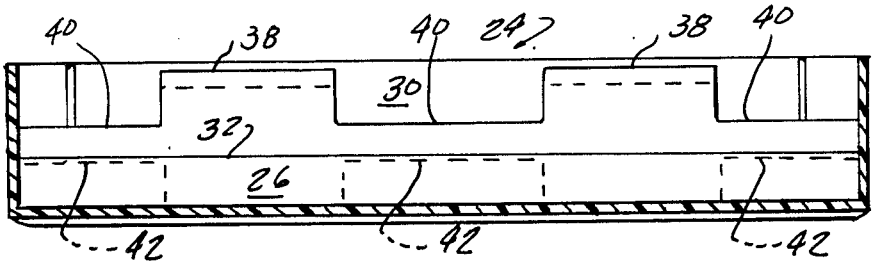
FIG. 6 is a cross-sectional view taken on line 6—6 of FIG. 1.
Figure 7:
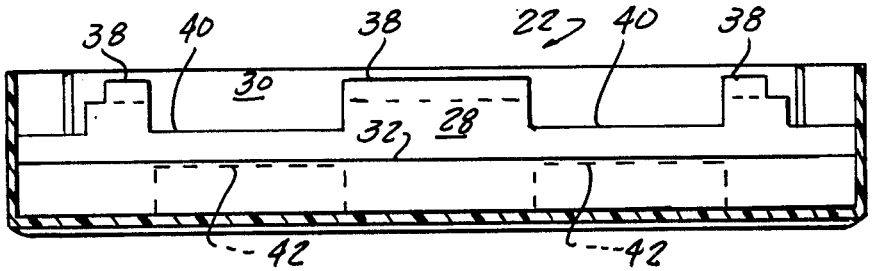
FIG. 7 is a cross-sectional view of the container taken on line 7—7 of FIG. 1.

The sidewalls 22 and 24, as best seen in FIGS. 2, 6 and 7, are of the same height. Generally speaking, the transverse cross section of sidewalls 22 and 24 at any given point longitudinally along the wall may take either of the two cross-sectional configurations shown in FIGS. 8 and 9 dependent upon the location at which the cross section is taken. However, as between walls 22 and 24, if the cross section of a wall 22 at a given point is the configuration of FIG. 8, then the cross-sectional configuration of a sidewall 24 and the cross bonding point will be that of FIG. 9.

Figure 8:
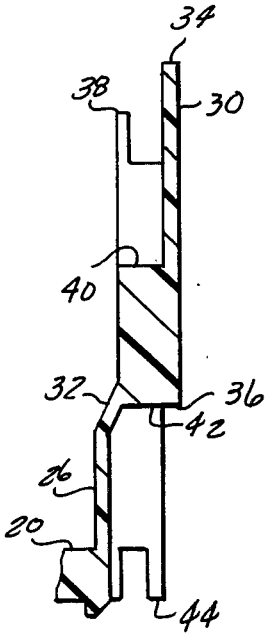
FIG. 8 is cross-sectional view of the sidewall of the container taken on the line 8—8 of FIG. 2.

Referring now particularly to FIG. 8, each sidewall which, in practice is a unitary, molded structure, may be considered to be divided into three vertical webs by vertical planes lying flush with the surfaces S1 and S2. That portion of the sidewall which lies to the left of the surface S1 as viewed in FIG. 8 is referred to as an inner web 26, that portion of the sidewall lying between the vertical surfaces S1 and S2 is considered a central web 28, and that portion of the sidewall lying to the right of the surface S2 is referred to as an outer web 30.

All of the webs 26, 28 and 30 extend the entire length of the sidewall. The inner web 26 projects upwardly from bottom 20 to a horizontal upper edge 32. Outer web 30 has a continuous horizontal upper edge 34 and a continuous horizontal lower edge 36. Central web 28 has a top edge which is defined by alternating upper edge sections and lower edge sections 38 and 40, respectively, and has a bottom edge which is defined by upper and lower edge sections 42 and 44, respectively.

Figure 3:
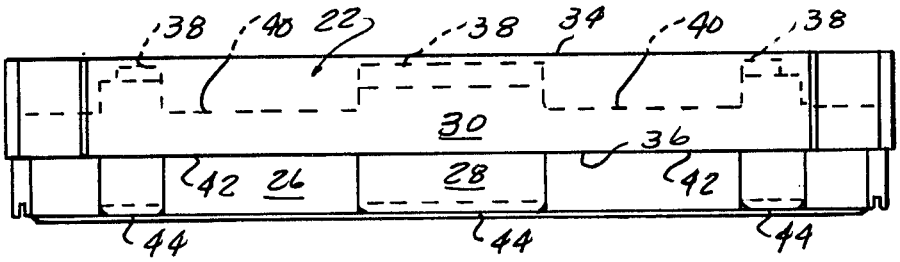
FIG. 3 is an end view of the container of FIG. 1.

Referring now to FIGS. 2 and 3, as well as FIGS. 6 and 7, it is seen that the upper edge sections 38 at the top of central web 28 are longitudinally aligned and coextensive with the lower edge sections 44 of the bottom edge of central web 28, and a similar relationship exists between the lower edge sections 40 of the top edge and the upper edge sections 42 of the bottom edge.

These central webs 28 of the various sidewalls define the stacking elements of the container, the inner web 28 essentially functioning to attach the central web to the bottom of the container and the outer web 30 functioning primarily as a peripheral retaining flange maintaining the stacked containers in vertical alignment with each other.

Considering the central web 28 itself, the upper and lower edge sections at the top and bottom of the web are so arranged that each central web consists of alternating vertically narrow and vertically wide sections. As between the sidewalls 24 and the sidewalls 22, these vertically narrow and wide sections are complementary—that is, as best seen in FIGS. 2, 3, 6 and 7, in the central portion of the sidewalls 22, there is a vertically wide section of the central web defined between the upper edge section 38 of the top edge of the web and the lower edge section 44 of the lower edge of the central web, while the sidewalls 24 have a vertically narrow section in this same central portion.

Figure 5:
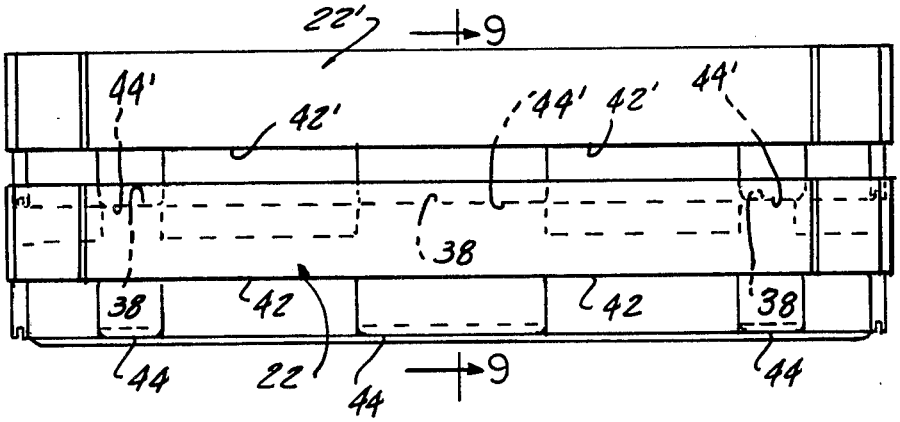
FIG. 5 is a view similar to FIG. 4, showing the containers in a high stacked relationship to each other.
Figure 9:
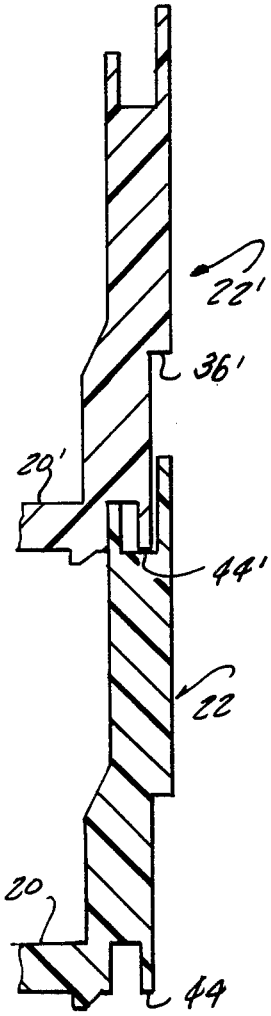
FIG. 9 is a cross-sectional view taken on the line 9—9 of FIG. 5.

When two of the containers are stacked with the sidewalls 22 of the upper container resting on the sidewalls 22 of the lower container, the lower edge sections 44 of the central web of the upper container will rest upon the upper edge sections 38 of the lower container as shown in the cross-sectional view of FIG. 9 and the side view of FIG. 5. In these two figures, the various parts of the upper container have been identified with primed reference numerals. As indicated in FIGS. 5 and 9, when two containers are stacked with like sidewalls 22 one upon the other, the two containers are in a high stacked relationship to each other. It will be appreciated that when the containers are stacked with the sidewalls 22, 22' stacked upon each other, the sidewalls 24, 24' of these two containers will necessarily likewise be stacked one upon the other. In that the two sidewalls 22 of a container are identical, it does not matter which of the sidewalls 22 of the upper container is stacked upon a given sidewall 22 of the lower container. Thus, the high stacked relationship can be achieved in either of two orientations separated by 180° of the upper container relative to the lower container.

Figure 4:
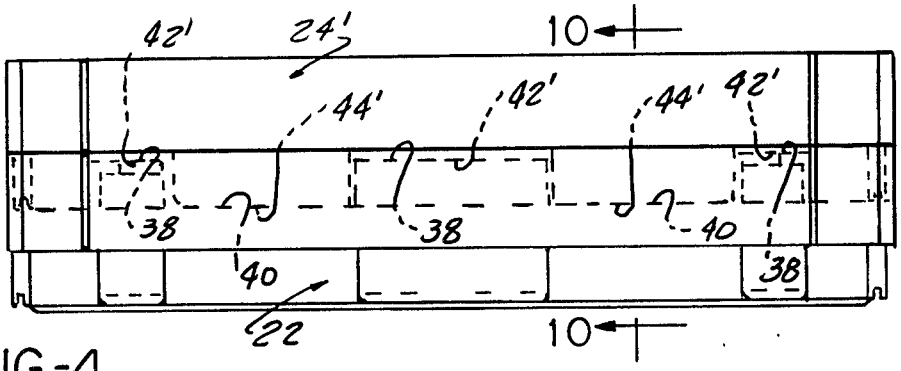
FIG. 4 is a side view of two of the containers of FIG. 1 in a low stacked relationship to each other.
Figure 10:
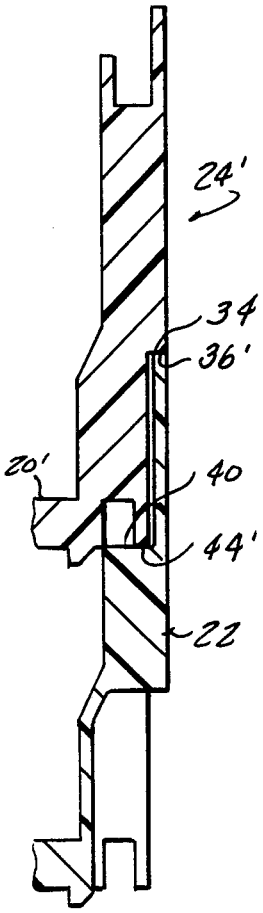
FIG. 10 is a cross-sectional view taken on the line 10—10 of FIG. 4.

To stack the containers in a low stacked relationship, the sidewalls 24' of the upper container are stacked upon the sidewalls 22 of the lower container which places the containers in the configurations shown in FIGS. 4 and 10. In this low stacked relationship, the relatively vertically wide portions of the central webs of the upper container are seated upon the relatively vertically narrow sections of the lower container.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. A multi-level stacking container comprising a square bottom, a pair of like first sidewalls projecting upwardly respectively from two opposed sides of said bottom, a pair of like second sidewalls projecting upwardly respectively from the other two opposed sides of said bottom, all of said sidewalls being of the same height, each of said sidewalls comprising an inner web joined along its lower edge to said bottom along one side thereof and projecting upwardly from said bottom to a horizontal upper edge, an outer web offset outwardly from said inner web, said outer web having a horizontal upper edge and a horizontal lower edge at substantially the same elevation as the upper edge of said inner web, a central stacking web integrally joined to and disposed between said inner and outer webs, said stacking web having a top edge of upwardly facing alternate horizontal upper and lower edge sections lying respectively at first and second distances below the upper edge of said outer web and a bottom edge of downwardly facing alternate horizontal upper and lower edge sections lying respectively at first and second distances below the upper edge of said inner web, the upper and lower edge sections of said top edge being respectively coextensive with the lower and upper edge sections of said bottom edge longitudinally of said wall and said upper and lower edge sections being symmetrically arranged relative to an imaginary vertical line located midway between the opposite ends of the sidewall, said first sidewalls each having an upper edge section of its top edge located midway between the ends of the walls and said second sidewalls each having a lower edge section of its top edge located midway between the ends of the walls.

2. The invention defined in claim 1 wherein the distance between the upper edge of said outer web and the lower edge sections of said top edge of said stacking web is equal to or greater than the distance between the upper and lower edge sections of the bottom edge of said stacking web.

* * * * *

UNITED STATES PATENT OFFICE

CERTIFICATE OF CORRECTION

Patent No. 4,619,366 Dated October 28, 1986

Inventor(s) Elsmer W. Kreeger

It is certified that error appears in the above-identified patent and that said Letters Patent are hereby corrected as shown below:

Sheet 2, Fig. 4, the section line arrows have been changed, indicating a section cut viewed from the left to the right side of the figure. Sheet 3, Fig. 8, the reference numerals S1, S2, and 28 have been added with corresponding leader lines.

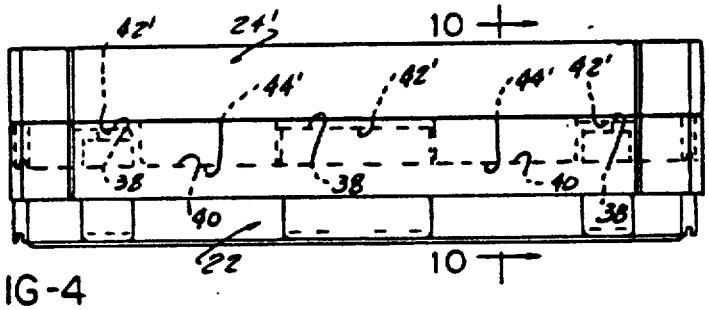

FIG-4

Signed and Sealed this

Seventeenth Day of February, 1987

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,619,366

DATED : October 28, 1986

INVENTOR(S) : Elsmer W. Kreeger

It is certified that error appears in the above-identified patent and that said Letters Patent is hereby corrected as shown below:

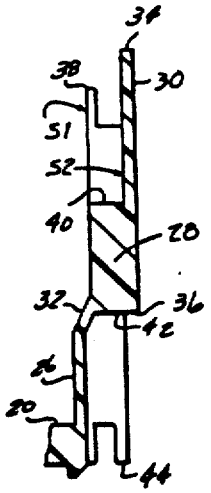

FIG-8

Signed and Sealed this

Seventeenth Day of February, 1987

*Attest:*

DONALD J. QUIGG

*Attesting Officer*

*Commissioner of Patents and Trademarks*